US006270931B1

(12) United States Patent
Morton

(10) Patent No.: US 6,270,931 B1
(45) Date of Patent: Aug. 7, 2001

(54) INTEGRAL IMAGING WITH ELEMENT HAVING ANTI-HALATION LAYER

(75) Inventor: Roger Roy Morton, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/577,281

(22) Filed: Dec. 22, 1995

(51) Int. Cl.[7] ..... G03C 9/00; G03C 9/08; G03C 11/08; G03C 1/76

(52) U.S. Cl. ..... 430/11; 430/14; 430/403; 430/510; 430/513; 430/496; 430/950; 359/463

(58) Field of Search ..... 430/510, 11, 14, 430/403, 496, 950, 513; 354/112; 355/22, 26, 33, 78; 359/463

(56) References Cited

U.S. PATENT DOCUMENTS

| | | | |
|---|---|---|---|
| 1,817,963 | 8/1931 | Capstaff . | |
| 1,918,705 | 7/1933 | Ives . | |
| 2,002,090 | 5/1935 | Ives . | |
| 2,039,648 | 5/1936 | Ives | 95/18 |
| 2,499,453 | 3/1950 | Bonnet | 88/1 |
| 2,500,511 | 3/1950 | Bonnet | 88/1 |
| 2,785,976 | 3/1957 | Ogle | 96/81 |
| 3,751,258 | 8/1973 | Howe et al. | 96/81 |
| 4,190,321 | 2/1980 | Dorer et al. | 350/165 |
| 4,252,843 | 2/1981 | Dorer et al. | 427/162 |
| 4,618,552 | 10/1986 | Tanaka et al. | 430/60 |
| 5,246,823 | 9/1993 | Shuman | 430/510 |
| 5,349,419 | 9/1994 | Taguchi et al. | 355/22 |
| 5,359,454 | 10/1994 | Steenblik et al. | 359/463 |
| 5,639,580 * | 6/1997 | Morton | 430/11 |

FOREIGN PATENT DOCUMENTS

| | | |
|---|---|---|
| 560 180 | 9/1993 | (EP) . |
| 312 992 | 5/1930 | (GB) . |
| 492 186 | 9/1938 | (GB) . |
| 51-056225 | 5/1976 | (JP) . |
| 4 097 345 | 3/1992 | (JP) . |

* cited by examiner

*Primary Examiner*—Thorl Chea
(74) *Attorney, Agent, or Firm*—William F. Noval

(57) ABSTRACT

A method of exposing an integral imaging element having: an integral lens sheet with opposed front and back surfaces; a light sensitive layer positioned behind the back surface; and an anti-halation layer between the light sensitive layer and the back surface;

the method comprising the steps of:

simultaneously exposing a major portion of the area of the light sensitive layer with light from behind the light sensitive layer, or simultaneously exposing the light sensitive layer to all of an integral image from behind the light sensitive layer.

28 Claims, 1 Drawing Sheet

INTEGRAL IMAGING WITH ELEMENT HAVING ANTI-HALATION LAYER

FIELD OF THE INVENTION

The invention relates generally to the field of integral image elements which may display depth, motion or other images, and methods of making such elements.

BACKGROUND OF THE INVENTION

Integral image elements which use a lenticular lens sheet or a fly's eye lens sheet, and a three-dimensional integral image aligned with the sheet, so that a user can view the three-dimensional image without any special glasses or other equipment, are known. Such imaging elements and their construction, are described in "Three-Dimensional Imaging Techniques" by Takanori Okoshi, Academic Press, Inc., New York, 1976. Integral image elements having a lenticular lens sheet (that is, a sheet with a plurality of adjacent, parallel, elongated, and partially cylindrical lenses) are also described in the following Unites States patents: U.S. Pat. No. 5,391,254; U.S. 5,424,533; U.S. 5,241,608; U.S. 5,455,689; U.S. 5,276,478; U.S. 5,391,254; U.S. 5,424,533 and others; as well as allowed U.S. patent application Ser. No. 07/931,744. Integral image elements with lenticular lens sheets use interlaced vertical image slices which, in the case of a three-dimensional integral image, are aligned with the lenticules so that a three-dimensional image is viewable when the lenticules are vertically oriented with respect to a viewer's eyes. Similar integral image elements, such as described in U.S. Pat. No. 3,268,238 and U.S. 3,538,632, can be used to convey a number of individual two-dimensional scenes (such as unrelated scenes or a sequence of scenes depicting motion) rather than one or more three-dimensional images.

Integral image elements using reflective layers behind the integral image to enhance viewing of the integral image by reflected light, are also described in U.S. Pat. No. 3,751,258, U.S. 2,500,511, U.S. 2,039,648, U.S. 1,918,705 and GB 492,186.

Previous lenticular imaging methods typically used a method for exposing the images through the lenticular material. This causes flair because multiple views must be exposed and each view introduces a background flair into the overall scene due to light scatter from the lenticular material. Resolution is also lost because the lenticular material does not have as high an optical resolution as is necessary for high quality imaging and as a consequence resolution is lost during the exposure of the image.

A technique for exposing a light sensitive layer on the flat back side of a lenticular sheet, has been previously described in U.S. Pat. No. 5,276,478. One difficulty with exposing from behind in this manner is that some light will pass through the light sensitive layer and be reflected back at an angle from the front surface of the lens sheet, to expose additional areas of the light sensitive layer. This effect, known as halation, results in a loss of sharpness in the recorded image. The possibility of using an antihalation layer between the sheet and recording layer is mentioned in U.S. Pat. No. 5,276,478. However, the light source described is a point source of light (such as a laser, LED or CRT) which is scanned over the recording layer from the back side to form the image. This necessarily requires a relatively complex scanning mechanism with its associated circuitry and mechanical parts.

It would be desirable then, to provide a method of obtaining an integral image element by exposing a light sensitive layer on the back side of an integral lens sheet from behind the light sensitive layer by a means which does not require scanning a spot source of light. Such a method should also result in low flair and high resolution, as well as low halation.

SUMMARY OF THE INVENTION

The present invention recognizes that other exposing methods than a scanning light spot source can be used to expose an integral image from behind the light sensitive layer. However, the present invention further recognizes that the problem of halation encountered with such other methods can differ from that encountered in a scanning light spot method. It is believed the following explanations accounts for this although it is not intended to be limiting in terms of the mechanism which may be involved.

First, in the case of exposing with a narrow collimated light beam as is found in scanner optical systems, there will be less scattered light which can cause halation and consequent loss of resolution and contrast. By comparison, other printing techniques use less collimated light sources.

Second, it is known that light sensitive layers, such as light sensitive silver halide emulsions, are not linear in their response at lower light levels. Where a first photon is absorbed in the light sensitive layer and is not shortly followed by a second photon, the effect of the first photon will be lost. This phenomena is described, for example, in T. H. James, editor, *The Theory of the Photographic Process*, 4th Edition, Macmillan, New York, 1977, particularly at pages 134–136. Thus, the effect of two simultaneous photons versus two photons spaced apart in time, is not the same (the first case may produce a developable spot on a photographic element, while the second produces nothing).

In the situation where a large area of the light sensitive layer of an integral imaging element is simultaneously exposed from behind the light sensitive layer, a given location may receive a certain amount of photons "H" from halation (that is, which has been reflected from the front surface of the element), over some small time period, $\Delta t$. In the case of a scanning light spot though, over the same amount of time the photons from halation can only come from reflections from the single spot and will therefore be some fraction of "H" (assuming the final image is to be exposed the same amount in both methods). In a case of the large area exposure then, since there will be many more total photons from halation at a given point in a light sensitive layer, a first photon from halation is likely to be more closely followed in time by a second photon from halation than will be the case in the scanning single spot (even though the total halation may be the same over the entire time of the exposure). As already discussed, in the second case the effect of the first photon is more likely to be lost, thereby producing less halation. Thus, using a method of eliminating halation in a large area exposure of an integral imaging element can produce an advantage which is not expected from a consideration of the scanning light spot method.

The present invention then, provides a method of exposing an integral imaging element having: an integral lens sheet with opposed front and back surfaces; a light sensitive layer positioned behind the back surface; and an anti-halation layer between the light sensitive layer and the back surface;

the method comprising the steps of:

simultaneously exposing a major portion of the area of the light sensitive layer with light from behind the light sensitive layer, or simultaneously exposing the light sensitive layer to all of an integral image from behind the light sensitive layer.

The method of the present invention then, provides a means of obtaining an integral image element of the present invention, which has low flair and high resolution as well as low halation, while not requiring any scanning mechanism for a light spot.

BRIEF DESCRIPTION OF THE DRAWINGS

To facilitate understanding, identical reference numerals have been used, where possible, to designate identical elements that are common to the figures.

EMBODIMENTS OF THE INVENTION

It will be appreciated in the present invention, that while the integral lens sheet could be a fly's eye lens sheet it is more preferably a lenticular lens sheet with lenticules on the front surface. Alternatively, the integral lens sheet could have regions of varying indices of refraction through its volume configured in such a way as to provide (in conjunction with the surfaces of the sheet, such as a curved external suface, flat external surface or some other shape) the same optical deflection of light rays as would be provided by a conventional fly's eye or lenticular lens sheet. Also, the back surface of the lens sheet may also be curved so as to either strengthen the lens effect or compensate for the curved focal plain which may be inherent in the lens consturction. Consequently, the curvature on the back side may be the of such a shape as to match the curvature of the focal plain of the lens. Further, by an "integral" image is referenced an image composed of segments (lines, in the case of a lenticular lens sheet) from at least one complete image (and often more than one image), which segments are aligned with respective individual lenses so that each of the one or more images is viewable when a user's eyes are at the correct angle relative to the imaging element. An "integral imaging element" in the present case is used to refer to a element which, when properly exposed and processed (as may be necessary), can produce an integral image element. By "light" in the present application is meant to include visible light, as well as infrared and ultraviolet light.

Figure 1:
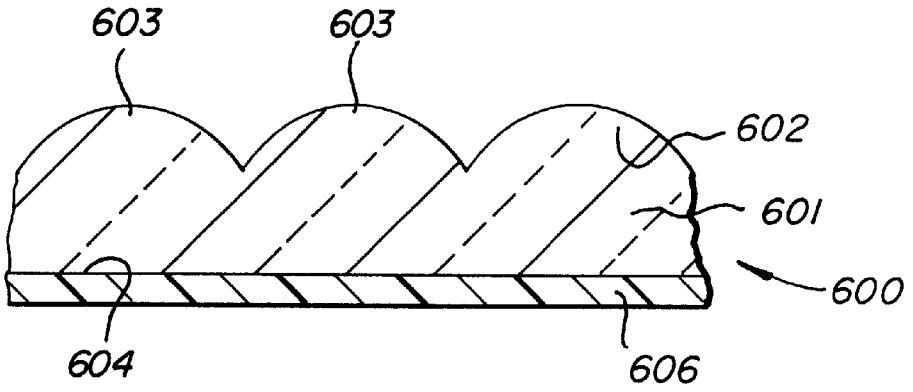
FIG. 1 is a cross-section illustrating a method of the present invention.

Referring now to FIG. 1, an integral imaging element 600 is shown which has an integral lens sheet in the form of lenticular lens sheet. Lens sheet 601 has opposed front and back surfaces 602, 604 respectively. Lens sheet 601 is of conventional construction with front surface 602 carrying the convex surfaces of a plurality of identical, elongated and adjacent partially cylindrical lens elements 603, while opposed back surface 604 is flat. Lens sheet 601 is preferably of uniform composition, having been cast, extruded, chill-rolled or formed in some other manner from material of the same composition. Further, lens sheet 601 is preferably of unitary construction in that it is preferably not composed of laminated layers.

Figure 2:
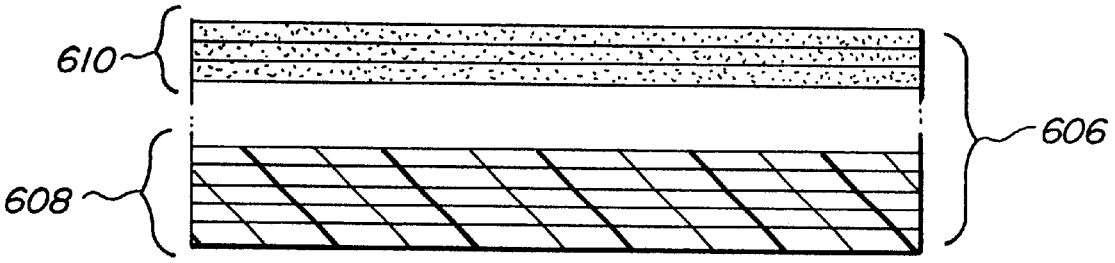
FIG. 2 is an enlarged view of a portion of FIG. 1.

A photographic layer 606 is positioned behind back surface 604, specifically immediately adjacent to back surface 604, by being directly attached to it. Referring to FIG. 2, photographic layer 606 has both one or more light sensitive layers 608 and one or more anti-halation layers 610. Light sensitive layers 608 may or may not be separated by interlayers, and at least one of them (preferably all of them) is a conventional photographic light-sensitive silver halide emulsion in a gel (preferably a gelatin gel). One or more anti-halation layers 610 are interposed between the one or more light sensitive layers 608 and the back surface 604. For simplicity the following discussion will refer to a single light-sensitive layer 608 and a single anti-halation layer 610, but it will be understood that the discussion applies the same to more than one layer of either of them.

An anti-halation layer is selected so as to absorb light, preferably visible light. In the case where the anti-halation layer absorbs visible light, it will appear colored and should be selected so as to be readily decolored (for example, by decomposition or removal of the colored compound). Each anti-halation layer 610 may particularly be a gelatin gel layer containing a suitable anti-halation dye in a medium such as a gelatin gel. An anti-halation dye is typically colored to absorb light, such as visible light, but is typically decolorized or removed during processing of the element. Suitable anti-halation dyes are well known in the field of conventional photography.

The integral lens sheet 601 may be formed by any suitable method, such as by chill rolling. Layers 608 and 610 may then be coated on back surface 604 in the order shown. This procedure results in the integral imaging element 600 shown in FIGS. 1 and 2 with an antihalation layer 610 directly attached to the back surface 604 of lens sheet 601. However, the foregoing arrangement is not essential to the present invention, and anti-halation layer 610 can be separated from back surface 604 and from light-sensitive layer 608 by one or more interlayers (not shown). As another alternative, layers 608 and 610 could first be provided on a suitable support with layer 608 being closest to the support. By a "support" in this context, is meant a body of sufficient rigidity as to allow the combination of the layers 608, 610 and support to be manually handled while maintaining its integrity (that is, without falling apart and without significant stretching). This combination (layers 608, 610 and support) can together be a conventional photographic film (for example, a color film with different sensitivity silver halide emulsion layers acting as different color records). This conventional film could then have its base laminated to the back surface 604 of lenticular lens sheet 601. However, in the embodiment of FIGS. 1 and 2 there is no intervening support between the anti-halation layer and the back side of the lenticular lens sheet.

In the present invention, exposure of an integral imaging element of the present invention, such as element 600, may be accomplished by a number of methods other than by scanning a light spot source. For example, a major portion of the area of the light sensitive layer 608 (such as an area of at least 1 $cm^2$ or even at least 5 $cm^2$), may be simultaneously exposed with light from behind light sensitive layer 608 (that is light from a direction beneath layer 608 as viewed in FIGS. 1 and 2). Also, the majority or all of the area of the light sensitive layer 608 could be simultaneously exposed with light from behind the light sensitive layer. Alternatively, any of the foregoing areas or some other some part less than all, or all, of the area of light sensitive layer 608 may be exposed simultaneously by exposing it to all of an integral image from behind the light sensitive layer. Such exposure could, for example, be accomplished by exposing the integral imaging element to light from an enlarger which has passed through, or been reflected from, an integral image. Such exposure could also be achieved by contact printing the integral imaging element using an integral image master. During exposure of light-sensitive layer 608 with light from behind it, layer 610 will reduce the amount of exposing light which might otherwise be reflected back toward light sensitive layer 608 from back surface 604 absent layer 610.

Following exposure, integral imaging element 600 is processed to develop and fix any image in light sensitive layer 608 as may be required depending on the constitution of layer 608. In the processing, any image is fixed to an unalterable form if it was not already so. Preferably during this processing (although it could be in a separate step), anti-halation layer 610 is decolorized when it is of a constitution that it absorbs visible light. Where light sensitive layer 608 is a light-sensitive silver halide, any of many known methods of silver halide photographic processing can be used The resulting final element will be a lenticular element. If exposure was with an integral image, then the final element will be an integral image element. In either event, the element will be transparent. For protection, layer 608 could be overcoated with any suitable transparent layer (not shown). Should it be desired to provide a reflection image, the layer 608 (now an image layer) may be covered with a reflective coating (not shown), such as a metal film or white paint, placed immediately behind and adjacent layer 608.

As previously mentioned, exposing any of the integral imaging elements previously described, from behind with a light pattern which represents an integral image and processing the exposed element (as may be required) to produces a visible integral image, results in an integral image element of the present invention. The formation of suitable integral images by interlacing lines from different scenes, and their exposing or writing to the back side of integral imaging elements, is described, for example, in U.S. Pat No. 5,278,608, U.S. 5,276,478 and U.S. 5,455,689. The integral image can, for example, be made of two or more images of a scene taken at different perspectives (that is, at different angular positions with respect to the scene). Such an integral image, when recorded on the light sensitive layer and viewed from a position forward of the front side of the lenticular lens sheet, may provide one or more three-dimensional images. By a "three-dimensional image", is meant an integral image which, when viewed through the front side of the lens sheet (that is viewed through the lens elements), has a visible depth element as a result of the various views being relationally configured to appear as the views that would be seen from different positions when actually viewing the three-dimensional object. A depth element means the ability to at least partially look around an object in the scene. This can be obtained by interlacing lines from different perspective views of the same scene, in a known manner. Thus, a three-dimensional image necessarily includes at least two views of a scene. Alternatively or additionally, the integral image may contain one or more two-dimensional images which may be recorded in alignment with the lens sheet so as to be viewable when the lenticules are positioned horizontally or vertically with respect to the user's eyes.

The invention has been described with reference to particular embodiments. However, it will be appreciated that variations and modifications can be effected without departing from the scope of the invention.

PARTS LIST

600 Imaging Element
601 Lens Sheet
602 Front Surface
603 Lens Elements
604 Back Surface
606 Photographic Layer
608 Light Sensitive Layer
610 Anti-Halation Layer

What is claimed is:

1. A method of exposing an integral imaging element having: an integral lens sheet with opposed front and back surfaces; a light sensitive silver halide emulsion layer positioned behind the back surface; and an anti-halation layer behind the back surface;

the method comprising the steps of:

simultaneously exposing the majority of the area of the light sensitive silver halide emulsion layer with light from from the back surface of said integral imaging element; wherein the integral lens sheet is a lenticular lens sheet with lenticules on the front surface.

2. A method according to claim 1 wherein the anti-halation layer is between the light sensitive layer and the back surface.

3. A method according to claim 1 wherein the anti-halation layer comprises a light absorbing dye.

4. A method according to claim 1 additionally comprising decoloring the anti-halation layer following exposure of the light sensitive silver halide emulsion layer.

5. A method according to claim 1 additionally comprising, following exposure, processing the light sensitive silver halide emulsion layer to fix any image from exposure.

6. A method according to claim 5 additionally comprising covering the light sensitive layer with a reflective layer after processing the light sensitive silver halide emulsion layer to fix any image from exposure.

7. A method according to claim 1 wherein the majority of the area of the light sensitive layer is simultaneously exposed by contact printing.

8. A method according to claim 1 wherein the integral lens sheet is uniform in composition and there is no intervening support between the lens sheet and the antihalation layer.

9. A method according to claim 8 wherein the antihalation layer is positioned immediately adjacent the back surface of the integral lens sheet.

10. A method according to claim 8 additionally comprising, following exposure, processing the light sensitive layer to fix any image from exposure.

11. A method according to claim 1 wherein the integral lens sheet is of non-laminated construction and there is no intervening support between the lens element and the anti-halation layer.

12. A method according to claim 11 additionally comprising, following exposure, processing the light sensitive layer to fix any image from exposure.

13. A method according to claim 1 wherein the integral lens sheet is uniform in composition and there is no intervening support between the lens element and the antihalation layer.

14. A method according to claim 1 additionally comprising, prior to the exposing step, laminating a support carrying the light sensitive silver halide emulsion and anti-halation layers, to the lens sheet.

15. A method according to claim 14 additionally comprising, following exposure, processing the light sensitive silver halide emulsion layer to fix any image from exposure.

16. A method of exposing an integral imaging element having: an integral lens sheet with opposed front and back surfaces; a light sensitive silver halide emulsion layer positioned behind the back surface; and an anti-halation layer positioned behind the back surface;

the method comprising the steps of:

simultaneously exposing the light sensitive silver halide emulsion layer with light to all of an integral image from from the back surface of said integral imaging element; wherein the integral lens sheet is a lenticular lens sheet with lenticules on the front surface.

17. A method according to claim 16 wherein the anti-halation layer is between the light sensitive silver halide emulsion layer and the back surface.

18. A method according to claim 16 wherein the light sensitive layer comprises a light-sensitive silver halide emulsion.

19. A method according to claim 18 wherein the integral lens sheet is uniform in composition and there is no intervening support between the lens sheet and the antihalation layer.

20. A method according to claim 19 wherein the majority of the area of the light sensitive layer is simultaneously exposed by contact printing with the integral image.

21. A method according to claim 19 additionally comprising, following exposure, processing the light sensitive silver halide emulsion layer to fix any image from exposure.

22. A method according to claim 18 wherein the integral lens sheet is of non-laminated construction and there is no intervening support between the lens sheet and the antihalation layer.

23. A method according to claim 16 wherein the anti-halation layer comprises a light absorbing dye.

24. A method according to claim 16 additionally comprising decoloring the anti-halation layer following exposure of the light sensitive silver halide emulsion layer.

25. A method according to claim 16 additionally comprising, following exposure, processing the light sensitive silver halide emulsion layer after processing the light sensitive silver halide emulsion layer to fix any image from exposure to fix any image from exposure, and covering the light sensitive layer with a reflective layer.

26. A method according to claim 16 wherein the integral image is a three-dimensional integral image.

27. A method according to claim 16 additionally comprising, following exposure, processing the light sensitive silver halide emulsion layer to fix any image from exposure.

28. A method according to claim 16 additionally comprising, prior to the exposing step, laminating a support carrying the light sensitive silver halide emulsion and anti-halation layers, to the lens sheet.

* * * * *